United States Patent [19]

King

[11] Patent Number: 5,074,047

[45] Date of Patent: Dec. 24, 1991

[54] ANTI-PINCH DEVICE FOR CHAIN SAW

[75] Inventor: William C. King, Mercersburg, Pa.

[73] Assignee: Tuscarora Designs, Inc., Mercersburg, Pa.

[21] Appl. No.: 580,155

[22] Filed: Sep. 10, 1990

[51] Int. Cl.[5] ..... B27B 17/02

[52] U.S. Cl. ..... 30/382; 30/383

[58] Field of Search ..... 30/381, 382, 383, 384, 30/385, 386, 387, 371, 378

[56] References Cited

U.S. PATENT DOCUMENTS

| | | | |
|---|---|---|---|
| 3,042,088 | 7/1962 | Filion et al. | 83/102.1 |
| 3,384,136 | 5/1968 | Marin et al. | 30/382 |
| 3,636,996 | 1/1972 | Lanz | 30/371 |
| 3,754,328 | 8/1973 | Knerr | 30/382 |
| 3,808,684 | 5/1974 | Ludwig | 30/371 |
| 4,060,894 | 12/1977 | Hampton | 30/382 |
| 4,193,193 | 3/1980 | Holzworth | 30/382 |
| 4,290,202 | 9/1981 | Nadenhoff | 30/382 |
| 4,294,012 | 10/1981 | Lanz | 30/378 |
| 4,335,513 | 6/1982 | Owens | 30/382 |
| 4,447,953 | 5/1984 | Lombardino et al. | 30/382 |
| 4,524,519 | 6/1985 | Muehling | 30/382 |
| 4,945,641 | 8/1990 | Miller et al. | 30/382 |

*Primary Examiner*—Frank T. Yost
*Assistant Examiner*—Allan M. Schrock
*Attorney, Agent, or Firm*—Eckert Seamans Cherin & Mellott

[57] ABSTRACT

In one embodiment, the anti-pinch device includes a vertical support mounted normal to the saw blade of the chain saw. A pinch arm extends longitudinally above the saw blade and is mounted for translational movement along the length of the vertical support. The pinch arm is attached to a transversely movable mount by a pivot such that the pinch arm can pivotally move with respect to the vertical support and the mount and pinch arm can transversely move up and down the vertical support in a substantially free manner.

34 Claims, 5 Drawing Sheets

ANTI-PINCH DEVICE FOR CHAIN SAW

BACKGROUND OF THE INVENTION

1. Field of the Invention

The present invention relates to an anti-pinch device for chain saws.

2. Prior Art

When using a chain saw to cut wood, such as trees, logs, etc., it is not uncommon to utilize several other tools, such as wedges of steel or plastic, pry bars, chains or log lifters to move the wood such that the chain saw blade does not become trapped or pinched within the saw cut. In some situations, tree cutters must utilize an additional saw to cut out a severely pinched chain saw. To reduce the incidence of pinching, a potentially dangerous technique, called "under bucking", is used wherein the tree cutter undercuts the log and uses the top portion of the chain saw bar or blade to cut the bottom of the log. In normal cutting practice (called "over bucking"), the bottom of the saw bar is used, the log is beneath the saw blade or bar, and the direction of chain rotation pulls the saw to the work (neutralizing any cutting forces) requiring the operator only to guide the saw. In the "under bucking" technique, the top of the bar is used, and the log is above the saw blade or bar such that the saw is thrust towards the operator due to the direction of chain rotation. Accordingly, the operator has to supply the cutting reaction force in addition to guiding the saw and maintaining his stance. It is apparent that the safety of the under bucking operation is clearly inferior to the conventional over bucking method.

Under bucking traditionally is used when it s judged that the work (e.g., a log) is positioned such that saw pinching will occur if over bucking is attempted. The design of the present invention makes it not only impossible to under buck the log (with the pinch arm in place) but also eliminates the need that arose from the envisioned potential pinching tendencies in the over bucking operation.

The practice of under bucking is extremely dangerous for several reasons. It places the operator in an unstable position, leaves the underside of the chain saw bar or blade exposed (which could be disastrous in the event of chain breakage) and further, with today's powerful, high speed saws, the saw may suddenly come free thereby increasing the possibility that the saw will rotate backwards toward the tree cutter or operator. Since the tree cutter is bringing the saw either vertically upward or horizontally away from the initial cut, control of the saw may be lost and the cutter's stability is at risk.

Some improvements are available in the art to improve the operation and/or safety of chain saws. Chain brakes, upper hand guards and saw bar or blade nose protectors are available and are primarily designed to minimize the injury due to kickback. These devices tend to impair or preclude some cutting procedures. For example, boring (cutting with the nose of the bar into a blind hole) is not possible with a bar nose protector installed. As a result, the nose protector is quite often removed and never reinstalled. Similar efforts are somtetimes undertaken to defeat other safety features that are perceived as unwieldy for whatever reasons.

U.S. Pat. No. 3,042,088 Filion et al discloses a kerf spreader that is attached to the housing of a chain saw. The kerf or saw cut is maintained at its original width at a single point due to the insertion of a tapered disc carried on an arm that extends longitudinally along a portion of the chain saw blade. The arm holding the kerf spreading disc is maintained in a housing such that the arm can move longitudinally with respect to the housing. The housing for the arm is rotatably attached to the chain saw motor mount.

U.S Pat. No. 3,636,996 to Lanz discloses a chain saw anti-pinch guard arm that is pivotally mounted to the chain saw housing and forms a lever, one end of which is attached to the chain saw blade. U.S. Pat. No. 4,294,012 to Lanz discloses a chain saw anti-pinch guard arm with a handle and an arm that is pivotally attached to the chain saw blade. U.S. Pat. No. 4,447,953 to Lombardino et al discloses a chain saw guard that is in a plane substantially perpendicular to the flat plane defined by the saw blade. U.S. Patent No. 4,335,513 to Owens discloses a safety bar for a chain saw that is pivotally mounted to a handle of the chain saw. U.S. Pat. No. 4,290,302 to Nadenoff discloses a chain saw guard that is relatively fixedly mounted above the chain saw blade in a plane substantially normal to the blade. U.S. Pat. No. 4,060,844 to Hampton discloses a chain saw safety bar that sits above the chain saw blade and is rotatably mounted to the chain saw housing. U.S. Pat. No. 3,808,684 to Ludwig discloses an attachment bar for a chain saw that consists principally of a sheath that covers almost all of the chain saw blade and is rotatably mounted on an aft region of the chain saw blade. U.S. Pat. No. 3,754,328 to Knerr discloses a guard for a chain saw that is also pivotally mounted to an aft region of the chain saw blade. U.S. Pat. No. 3,384,136 to Marin et al discloses a chain saw guard that is rotatably mounted to the chain saw housing.

OBJECTS OF THE INVENTION

It is an object of the present invention to provide an anti- pinch device for a chain saw that acts along the full length of the cut.

It is a further object of the present invention to provide an improved cutting system that has component parts that serve useful functions by themselves, e.g., a calibrated pinch arm, personalized arm, and log slide/-log roll arms.

It is another object of the present invention to provide a safety device that can be added to or integrated with a chain saw in a relatively easy manner.

It is a further object of the present invention to provide an anti-pinch device that utilizes a minimum amount of chain saw blade length as that safety device is attached to that minimum length.

It is another object of the present invention to provide a safety device that reduces vibrations caused by the log cutting operation.

It is a further object of the present invention to provide an anti-pinch device that can be combined with other safety features such as an instantaneous engine/-chain stop, broken chain catcher, etc., and/or kickback elimination.

It is a further object of the present invention to improve the productivity of the cutting operation.

It is another object of the invention to have a pinch arm of sufficient length with appropriate jaws that is able to minimize "log slide" and "log roll" of the severed log.

SUMMARY OF THE INVENTION

In one embodiment, the anti-pinch device includes a vertical support mounted normal to the saw blade of the chain saw. A pinch arm extends longitudinally above the saw blade and is mounted for translational movement along the length of the vertical support. The pinch arm is attached to a transversely movable mount by a pivot such that the pinch arm can pivotally move with respect to the vertical support and the mount and pinch arm can transversely move up and down the vertical support in a substantially free manner.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

Figure 1:
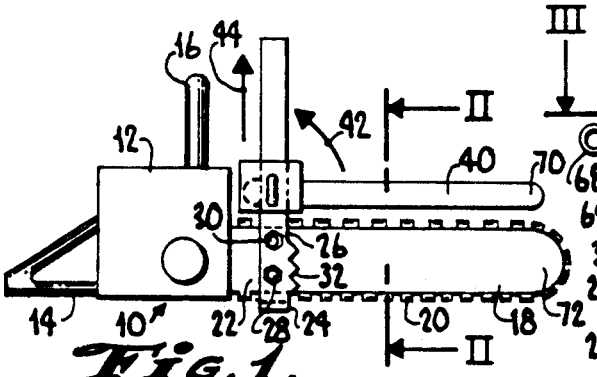
FIG. 1 illustrates a schematic or diagrammatic side view of a chain saw having one embodiment of the anti-pinch device mounted on the chain saw blade.

FIG. 1 illustrates chain saw 10 having a chain saw housing 12 and handles 14 and 16 such that the tree cutter can manipulate the chain saw. Chain saw 10 further includes chain saw blade 18 on which travels continuous cutting chain 20. Attached to an aft end region 22 of chain saw blade 18 is a vertical support 24. In this embodiment, vertical support 24 is mounted via screws 30 and 28. Extending from fore edge 30 of vertical support 24 are spiked bumpers 32. Spiked bumpers 32 are optional.

The anti-pinch device includes a pinch arm 40 extending longitudinally along saw blade 18. Pinch arm 40 is also generally normal to vertical support 24 and is mounted for both rotational movement as shown by curved arrow 42, as well as for translational or transverse movement along the length of support 24 as shown by arrow 44.

Figure 2:
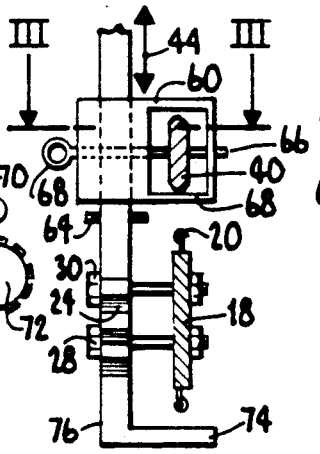
FIG. 2 is an enlarged view of the embodiment of the anti-pinch device and chain saw shown in FIG. 1 from the perspective of section line 2'—2" in FIG. 1.
Figure 3:
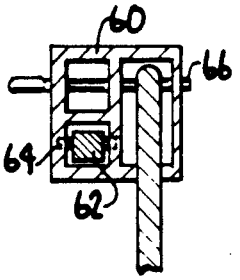
FIG. 3 is a partial, cross-sectional view of the anti-pinch device from the perspective of section line 3'—3" in FIG. 2.

FIG. 2 diagrammatically illustrates the anti-pinch device and the chain saw from the perspective of section line 2'—2" in FIG. 1. Saw blade 18 is mounted to vertical support 24 by, for example, threaded bolts 28 and 30. A transversely movable mount 60 has a through passage 62 (see FIG. 3 which is a cross-sectional view of the mount) such that mount 60 can move transversely or translate in direction 44 up and down vertical support 24. Of course, the mount cannot move below lower stop 64, which can be adjustable to allow for variations in wood hardness, and also chain wear (by design, as chains are sharpened, their effective cutting width decreases). Pinch arm 40 extends normal to vertical support 24 and is pivotally attached to mount 60 by rotating pin 66. Pin 66 has a pull ring 68 such that when the pinch arm is trapped between the upper and lower surfaces of the saw cut in a tree (or the side surfaces in a log), pin 66 can be removed by pulling on loop handle 68 and the pinch arm can remain in the saw cut while the saw is removed from the cut or is moved to finish the cut. Mount 60 also includes a lower rotation stop surface 68 that limits the rotational movement of fore end region 70 of pinch arm 40 (see FIG. 1) towards fore end region 72 of saw blade 18 so that it does not contact cutters. Further, it can also be seen that the arm can be removed quickly with no tools to facilitate these operations where it is not needed or might be in the way.

As an additional safety feature, vertical support 24 has a chain catcher bar 74 extending normal to the plane of the support at lower region 76. Chain catcher bar 74 will catch a chain that separates thereby providing an additional safety feature for the tree cutter. Bar 74 is optional and can also be a quick release design as shown in FIG. 4A.

Figure 4A:
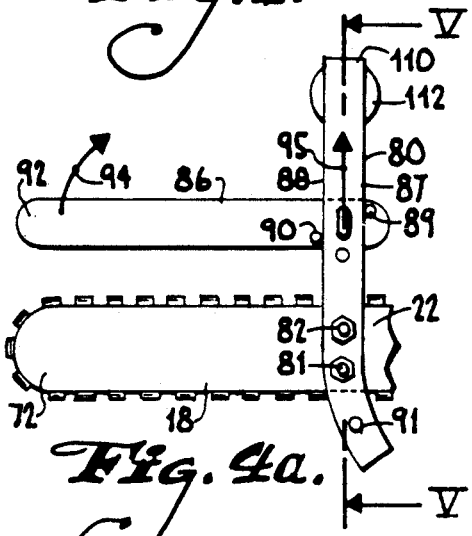
FIG. 4A is a diagrammatic illustration of second embodiment of the anti-pinch device showing a handle as an accessory.

FIG. 4A diagrammatically illustrates a second and the currently preferred embodiment of the anti-pinch device. Similar numerals designate similar items throughout all of the drawings.

Figure 4B:
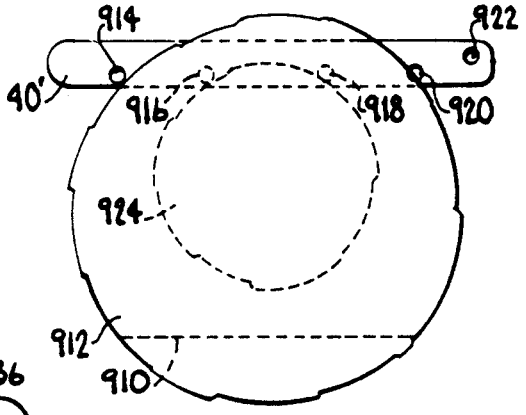
FIG. 4B diagrammatically illustrates a pinch arm independent of the saw.

Arm 40 (FIG. 1) or arm 86 (FIG. 4A) can also be used by itself as arm 40' as shown in FIG. 4B and placed into the cut 910 after the cut is sufficiently deep into log 912 to keep it open and reduce, if not eliminate, deadly kickback injury. Further, there can be a multiplicity of holes 914, 916, 918, 920 and 922, along the length of the arm 40'. Pins could be placed in the holes to control its insertion depth as shown in FIG. 4B. Quick release pins such as pins 89 and 90 in FIG. 4A could be used at each end of the arm. As the drawing shows, the quick release pins can also be positioned to facilitate the use of the arm on logs of all sizes. Smaller log 924 is shown in dashed lines. This feature is vitally important as it maximizes the efficiency of the anti-pinch operation by allowing placement of the arm near the top of the log to keep the cut open to the greatest width possible. This method of use also helps to prevent deadly "log slide" (the motion of the cut log relative to the tree trunk after severing) from occurring due to the interlock of the end arm pins with the trunk and the cut log which is discussed in more detail later.

Figure 4C:
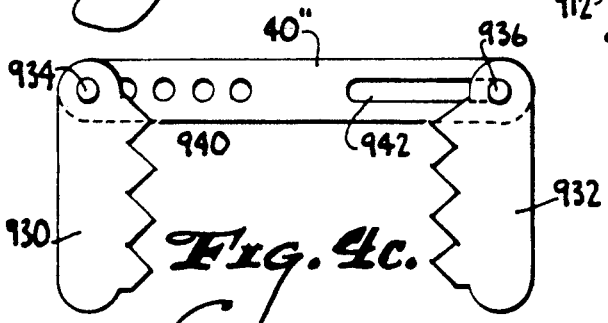
FIGS. 4C and 4D diagrammatically illustrate different embodiments of the pinch arm.

The pinch arm 40'' shown schematically in FIG. 4C is similar to the arm 40' in FIG. 4B with the addition of fore and aft dual spiked surfaces 930 and 932 to more positively lock onto heavier logs and straddle the cut staying in the upper most cut region to not only give positive pinch prevention but also to more effectively negate "log slide" for maximum operator safety. The straddle mount design will allow the spike surfaces to conform to the uneven log bark surfaces on either side of the cut (left and right) at both the fore and aft positions while still permitting the cutter bar to pass between them. The end spiked pieces can pivot with respect to pivot pins 934 and 936 to a limited degree and/or have a spring preload to help set the spikes and allow them to return to the "at rest" position (when not in use). Further, the cross piece (anti-pinch arm) 40'' can be adjustable to effectively accommodate logs of various diameters. This adjustment could be as simple as a multiplicity of adjustment holes, e.g., hole 940, or elongated slot 942 for the spike pivots to traverse. The insertion depth could be controlled by either traditional quick release pins or by the location of the spike pivots along the length of the anti-pinch arm. Once the spikes are locked into the log or the anti-pinch arm is locked into the cut, the possibility of kickback is very remote. The spiked end pieces will act to keep the cut end temporarily affixed to the trunk thereby increasing the "window" of opportunity for the operator to shut off his saw and safely move away from the cut log prior to its descent to a stable position. For handling large, heavy logs, there can also be a positive locking feature to insure that the spikes are locked into the logs for maximum safety in preventing "log slide." In this instance, to engage the log, the spiked end pieces are removably mounted at fixed pin positions, e.g., 914, 916, 918, 920 and 922 (FIG. 4B) along the anti-pinch arm at discrete and, in some instances automatic, locking locations. These locations can be designated with serrations, slots, quick release pin holes, screw thread adjustments, etc. It is important to note that the cut piece can only slip—rotation is not allowed (due to the engagement of the spikes with the trunk) since it is desired to only have the heavy severed log translate as it falls. The spikes, however, can gradually slide out of engagement with the trunk bark allowing the log to gently fall to the ground.

Figure 4D:
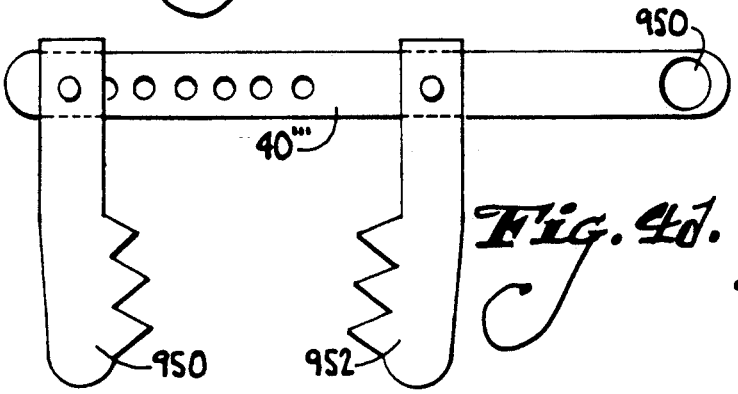

The basic hardware described in FIGS. 4B and 4C can be modified for use as shown in FIG. 4D. The anti-pinch arm 40'' is longer than normal with a lifting eye hole 950 to facilitate movement of the large heavy logs; this arm by itself, however, can still be used on a saw. The lifting eye hole 950 could also be fashioned to function as a hand grip to allow the manual movement of logs. Functionally, this hardware is to be mounted on the body of the log away from the cut so that, upon cut completion, "log roll" will be either prevented or minimized by the ground interaction with the projection of the extra long anti-pinch arm. This projection may be placed (or rotationally oriented) on the log so that it is "planted" into the ground when the log falls to or rolls on the ground. The "log roll" referred to is a significant problem on hilly terrain where the operator may put himself off balance to prevent the cut log from either rolling over/impacting him.

It should be noted that "log slide" and "log roll" are different phenomena. Log slide refers to the motion relative to the trunk of the cut log when the cut is finished—i.e., unacceptable log slide occurs when the log slides out of control towards the operator. Log roll relates to the motion of the cut log on the ground—i.e., whether the log's roll is unmanageable either to or away from the operator.

For log size adjustment the spike arms shown in FIGS. 4B, 4C and 4D translate along the anti-pinch arm and can be locked into position by any of various methods - pins, bolts, slots, serrations, etc. The grip surfaces are inwardly disposed toward each other (see spike end 950 canted toward spike end 952) so that the gripping force becomes greater as the log tries to escape from the device; as a consequence, the initial grip adjustment on the log is not critical. This feature also makes it very easy to release the device when the log is safely on the ground. All the operator has to do is to push the anti-pinch arm toward the log, thereby lessening the grip engagement with the log and allowing easy removal of the device. The grips are designed to be easily removed so that the anti-pinch arm can be exploited for its many other uses. It must be noted that this arrangement can be used with the anti-pinch arm in the cut with the grip surfaces used to prevent "log slide."

The pinch arm can be modified to make it better suited for direct use in the cut for pinch prevention. The adjustment and basic design of the grip members are similar to that explained above with respect to FIGS. 4C and 4D. The grip surfaces on arms 930 and 932, however, are different. The grips on the cut log side of the saw cut are spiked (to stay on the severed log throughout its journey to the ground) while those on the trunk side are smooth to allow the log to fall directly to the ground, guided by the trunk, thus preventing "log slide" to the side and thereby protecting the operator while enhancing productivity. The grip members 930 and 932 are elongated to extend above and below the anti-pinch arm to increase the length of time that the trunk has to impart guidance to the cut log in its fall to the ground. For that matter, the grip members could also be longer than shown extending below the pinch arm for earlier interaction with the ground to reduce the time that the log is in an unstable state. The elongated anti-pinch arm will still prevent "log roll" as noted above. The spacing of the grips (smooth to spiked) relative to the plane of the cut can be much greater than that shown on the drawings for enhanced stability and control of the cut log.

Further, the anti-pinch arm can also be calibrated or ruled for quick determination of log diameter and/or length thereby eliminating the need to carry along an extra tool. In fact, the only tool that one would need to carry along for cutting will be the anti-pinch arm which, if not on the saw, can be clipped to the operator's belt for convenient transport. As will be discussed later, the upright member can also be readily designed to incorporate storage of the anti-pinch arm when not is use for easy transport. The pinch arm could also be personalized to identify property and prevent theft.

Figure 5:
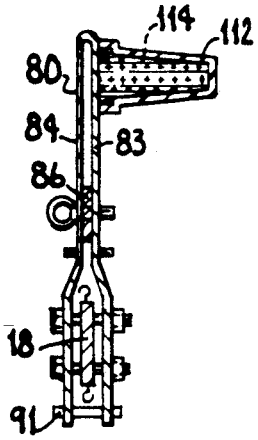
FIG. 5 is a partial, cross-sectional view of the anti-pinch device shown in FIG. 4 from the perspective of section line 5'—5"

FIGS. 4A and 5 show the same embodiment of the anti-pinch device and both figures will be referred to at the same time herein. Vertical support 80 is fixedly mounted to aft end region 22 of chain saw blade 18 by mounting bolts 81, 82. Vertical support 80 further includes a pair of parallel spaced apart support arms 83, 84 that extend normal to the longitudinal extent of saw blade 18. The top of the support arms may be joined together, thereby providing support for each other. If the top of vertical support 80 is left open, that is, arms 83 and 84 being spaced apart over their entire length, the pinch arm 86 will then be able to automatically leave the saw when it is pinched in a cut thereby eliminating the need to remove a quick release pin. Pinch arm 86 is both pivotally and transversely movable with respect to vertical support 80. Transverse or translational movement of pinch arm 86 with respect to vertical support 80 is accomplished by the aft end of the pinch arm being disposed between the parallelly spaced support arms 83, 84 of vertical support 80. Translational movement of pinch arm 86 is accomplished by a pair of guide pins on the pinch arm. Aft guide pin 89 is disposed near aft edge 87 of vertical support 80. Fore guide pin 90 is disposed near fore edge region 88 of vertical support 80. Fore guide pin 90 is disposed closer to saw blade 18 as compared with aft guide pin 89 such that nose region 92 (the fore end) of pinch arm 86 is adapted to rotate in direction 94 away from fore end region 72 of blade 18, upon pinching in the cut. Translational or transverse movement of pinch arm 86 generally in the direction of arrow 95 is accomplished by the fore and aft guide pins. Aft guide pin 89 includes a quick release mechanism (similar to that shown in FIGS. 2 and 3) such that when the pinch arm is trapped within the saw cut, the guide pin can be removed and the pinch arm can be detached from between support arms 83 and 84, thereby leaving the pinch arm in the saw cut and removing the vertical support as well as the attached saw blade. The guide pins therefore comprise the rotational and transverse mounting mechanism between the vertical support and the pinch arm. Lower movement is restricted by a lower stop 35, similar to stop 64 in FIG. 2, which may be adjustable to compensate for cut width variations due to specific chain size, chain wear and wood size/hardness.

Optionally, at top region 110 of vertical support 80, a handle 112 is attached for greater control and leverage. Handle 112 may include shock absorbing material 114 that is disposed in the interior of the handle, which isolates the vibrations from chain saw blade 18, due to cutting of the tree, from grip handle 112.

As an alternative to the handle 112 shown in FIG. 4A, an integrated design is possible. The integral handle would simply be a 90 degree bend in the parallel support arms 83 and 84 such that the bent end of the arms would form a handle similar to handle 112 in FIG. 5. In this embodiment, the handle is simply an extension of the upright arm 80 and would have a function similar to that of the separate handle 112. The integrated handle would also function to give added leverage and control. It could also function as a hand guard to protect the operator from accidental chain contact if his hand slipped from the grip affixed to the chain saw housing by the saw manufacturer. The integrated handle could also have some vibrational isolation features by encasing the hand grip region with an energy absorbing material that could be molded in place, wrapped, or slipped on.

Figure 6A:
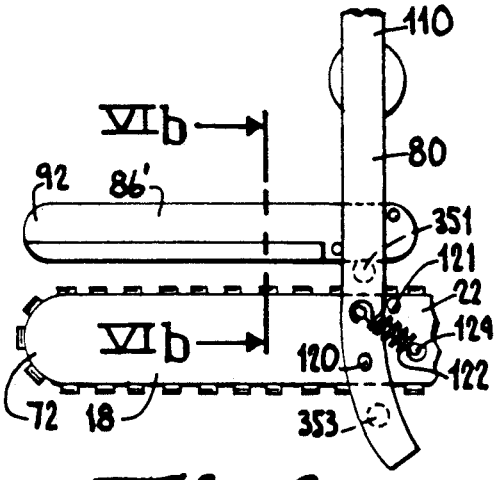
FIG. 6A is a diagrammatic illustration of a third embodiment of the anti-pinch device with a braking mechanism.

FIG. 6A illustrates a third embodiment of the present invention. In this embodiment, vertical support 80 is pivotally attached by pivot pin 120 to aft region 22 of saw blade 18. A biasing mechanism, or spring 122 is attached to either the aft end 22 of bar 18 or the chain saw housing at or near point 124 such that the top end region 110 of vertical support 80 is rotated away from fore end region 72 of saw blade 18. With the saw at rest, the rotational motion is terminated in the one direction by either the spring 122 or stop 121.

As shown in the sectional view of arm 86' (FIG. 6B), the anti-pinch arm has an inverted "T" shape with energy absorbing material 101 along its blade adjacent surface. This arm is attached in such a manner that it is either fixed or can translate, but it cannot rotate relative to the upright. Upon kickback, the upper hand grip would be thrust forward (due to reaction with the operator's arm/hand) causing the energy absorbing material 101 to impact the chain, terminating its motion and thereby protecting the operator from serious injury.

Figure 6B:
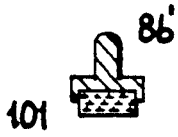
FIG. 6B is a cross-sectional view of arm 86' from the perspective of section line 6B'—6B" in FIG. 6A.

The arm shown in FIG. 6B can be used in the conventional manner by inverting it such that the "leg" of the "T" faces into the cut to act as a pinch preventer. It can also be used apart from the saw by itself to keep a cut open. In this instance, the "top" of the "T" would limit insertion into the cut insuring that the maximum cut width is maintained by the "leg" of the "T". If the top of vertical support 80 (FIG. 4A) is left open (rather than being closed as shown in FIG. 5), the pinch arm will automatically depart from the saw, staying in the cut, thereby providing pinch protection without any operator input. This automatic departure is only a function of cut depth and will not in any way impede the anti-pinch performance of the pinch arm. The open top feature of vertical support 80 (FIG. 4A) can be used with the standard anti-pinch arm as described above for fully automatic release of the arm when it is pinched in a cut without the removal of any pins. Further, when used with an extra quick release pin at the remote end 92 of the anti-pinch arm (pin not shown), the anti-pinch arm will always disengage from the uprights at the appropriate cut depth (which is dependent upon the log diameter) and stay in the uppermost region of the cut providing the most beneficial pinch protection, i.e., the widest cut.

The open top upright can also be used with a pinch arm without any quick release pins. When the arm becomes pinched in a cut, the operator will be able to simply saw away from the pinch arm while finishing the cutting operation. The automatic disengagement described above will also apply when a pin is used at the remote end of the pinch arm.

Using automatic release of the arm with a quick release pin at the remote end 92 of the arm 86', the anti-pinch arm not only eliminates pinching but also acts to interlock with the cut log by way of the quick release pins to effectively eliminate sideways motion relative to the trunk of the cut piece as it settles to the ground, thereby protecting the operator (most likely his leg) from "log slide" (or side shift).

This interlocking feature works regardless of whether or not pinching is involved. This problem has never been addressed and is further compounded by the use of conventional wedges to keep a cut open (to avoid pinching) as they make the condition even more unstable by prying the pieces even farther apart with additional potential energy to dissipate upon cut completion. The independent use of the previously discussed anti-pinch arm with the dual straddle mounted spiked ends (FIGS. 4C and 4D) is a more efficient method of "log slide" prevention but is somewhat more difficult to use directly on the saw. It is intended more for the larger/heavier logs and can easily be inserted into the cut when sufficiently deep to insure maximum pinch prevention along with minimized log slide tendencies as well as a good degree of kickback safety.

A further use may also be made of the open top upright design where convenient storage is made for the anti-pinch arm when its use is not desired. The storage is easily facilitated by inserting the pinch arm between the uprights such that all the elements are stacked or interleaved together. The longitudinal aspects of the pinch and upright arms are aligned on top of each other. The quick release pins fasten the stacked parts. The arm stored between the uprights may also have some additional safety benefits in preventing a hand slipping from the factory mounted hand grip ending in the chain.

As a further improvement into the saw control during kickback, the forward movement of upright 80 (due to the operator's arm during a kickback event) with respect to stop 121 can activate an electrical shut off device to stop the engine power (or electrical power in the case of an electric motor driven saw) to the chain saw. The switch senses the relative motion between upright 80 and the chain saw proper. The switch could be attached to the spring 122. In reality, this could also easily be strictly a mechanical interlock/interface with the factory ignition (power) switch. Further, this shut off could skip (or combine with) the ignition and function on the air/fuel system; an interlock with a choke such that, in a kickback event, it is rapidly closed to instantly flood and stop the engine. The power shut off device could also easily function to immediately bring the throttle back to idle position. A combination of these shut off methods could be used to ensure a fail safe system.

The engine power shut off can be of vital importance when one considers that, while the operator is trying to firmly hold, control, and guide his saw with both hands, his right index finger is controlling the throttle which makes it virtually impossible to either release the throttle and/or turn off the ignition in time to effectively react to a kickback episode. Human reaction times and mental processing capabilities are simply not quick enough to judge that there is a problem, determine its severity, and perform the appropriate response in time to avoid injury.

There are other locations for a shut off device. The shut off device could also be mounted on a hand guard and actuated by operator contact with the guard during kickback or it could be integrated into the factory mounted upper hand grip or the added handle 112 (FIG. 4A) and actuated by additional hand pressure as would occur during a kickback episode. In essence, this could be a surface mounted switch that would be activated upon hand pressure at the hand grip interface with the user. This activation could be as a consequence of kickback or it could be initiated by the operator by simply squeezing the grip. Further, it could be simply a hand operated "toggle" switch at the hand grip. The electrical shut off mode could be as simple as an ignition grounding switch to kill the engine.

This method of engine shutoff could even work without an upper hand grip on the anti-pinch device if the pinch arm is either locked into the cut or if it is designed to lock upon forced expulsion from the cut using any of the design features illustrated in FIGS. 12 through 18. This would make the proposed device somewhat more automatic in operation allowing the operator full use of the original factory hand grips. In summary, it should be understood that the electrical or mechanical switch embodiment could be easily used with the "standard" pinch arms 40 (FIG. 1), 86 (FIGS. 4A and 5) and auxiliary handle 112 (FIG. 4A), or the special pinch arms described above without any extra handles, or without any arm at all but with a handle on the upright.

The biasing mechanism trip force requirement could be adjustable to customize the saw to the operator's individual characteristics—strength, size, etc. This modification could be as simple as an elongated slot provided on the upright to allow for variations in the tensioning of the biasing spring.

The engine shut off switch in conjunction with the energy absorbing material of arm 86' (FIG. 6A) could be combined into a two-step process to protect the operator from the hazards of kickback. First, the engine power would be stopped due to the electrical switch or one of the mechanical shut off devices described above. Second, occurring only milliseconds later, the chain would be physically and instantly stopped by contact with the energy absorbing material as the upright member is thrust forward. It should be noted that these two events occur in a single continuous motion of the upright that can be initiated by either the saw (automatically during kickback) or manually by the operator at any time.

Figure 6C:
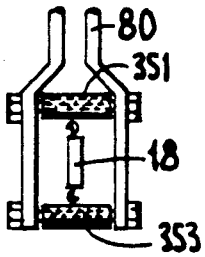
FIG. 6C is a partial, cross-sectional view of the upright arm showing brake rollers.

In addition to or in place of the energy absorbing feature of arm 86' (FIG. 6B), the energy absorbing attributes could be incorporated into brake roller elements 351 and 353 shown in FIG. 6A and shown schematically in cross-section in FIG. 6C. These are mounted on the upright 80 such that, as the upright is thrust forward, the brake rollers impact both the top and the bottom of the chain 18 stopping its motion after the electrical or mechanical switch, if used, has stopped the engine. These "rollers" would be made of an energy absorbing material and do not actually have to rotate (they could be partially or fully locked) and could be of any geometric form—circular, square, triangular, rectangular, etc. They could also be flat shoes or pads and could be arranged to operate on the relatively smooth sides of the chain below the side cutting surfaces. It should be noted that the path of the roller elements during a kickback (with the upright thrust forward) is such that they are both jammed into the chain due to their eccentric path relative to the pivot.

The use of the roller brake elements with the kickback actuated electrical engine shut off referred to above is preferable; this is an optimum method but individual use is also acceptable. Also, this engine/chain stop method is operational with or without the anti-pinch arm with the same considerations as noted above. During kickback, however, its operation is enhanced with the anti-pinch arm as its interaction in the cut would tend to rotate the upright thus initiating the shut-off mode.

It is also possible to use the roller reaction with the chain upon kickback to actuate the engine stop switch. This method separates the shut off switch actuation from the movement of the uprights and only senses actual engagement of the roller element with the chain which is when engine shut off is really needed.

It must also be pointed out that, in any relative position of the upright 80, the brake elements, in general, will act to not only catch but also to decelerate a broken chain by absorbing its kinetic energy in a manner similar to that of the chain brake regardless of where the chain breaks (top or bottom), thus dramatically lessening (if not totally preventing) the degree of operator injury. The broken chain will wrap upon the brake elements rather than the operator's arm.

As mentioned above, the chain brake elements could be of virtually any geometric form. As an example, the uprights may be encased or surrounded in an elastomer that has ribs extending across the plane of the chain both above and below the cutters. These ribs are positioned such that they can be employed to stop the chain when used with pivoting upright members. Further, the ribs will act as both a upper and lower chain catcher and absorb the chain's energy in the event of a broken chain. The elastomer also has the added benefit of absorbing cutter induced vibrations when used as a cutting force reaction member thereby protecting the operator from the harmful effects of excessive exposure to high levels of vibration. If a conformable elastomer is used as a cutting reaction force element, its deformation will allow it to interlock with the relatively rough surface of the tree bark yielding improved operator control consequently minimizing the need for add on spike bumpers.

It must be pointed out that other chain decelerating means can be employed singly or in combination with the engine power shut off system. For example, one or both of the roller elements could easily react with the smooth clutch cover to instantly stop the chain. This is possible since, in virtually all saws, the clutch cover is directly linked to the chain through the integral chain driving sprocket. The engine shut off device could also easily be integrated with the clutch cover brake elements.

It should be noted that, by design, the uprights 80 are forced back to the stop pin 121 (FIG. 6A) (or a stop switch) by the cutting reaction forces during normal cutting. The uprights are only thrust forward during a kickback episode by interaction with the operator's hand through handle 112 (FIG. 4A), through interaction with the locked anti-pinch arm, or by manual actuation. This concept is of great importance when used with the upright mounted handle but without the anti-pinch arm since it effectively eliminates the use of the marginally safe under- bucking cutting technique because the engine will shut off when used with a light upright bias setting. If used with a heavier bias setting, under-bucking will be allowed but with a good degree of safety (engine shut off) if the saw starts thrusting toward the operator in an uncontrolled manner.

In addition to reduced material costs and lower bulk when compared to the various band brake systems, engine power shut off with chain stop also has the added benefit of vastly reduced maintenance since the energy dissipation associated with decelerating a non-powered chain is minimal (and is basically a function of chain inertia and is aided by chain/bar friction) unlike that of the powered chain of the band brake clutch cover system as detailed below. The pivoting upright first shown in FIG. 6A has the advantage of automatic resetting after use unlike that of the band brake system which must be reset manually after each use.

Figure 7:
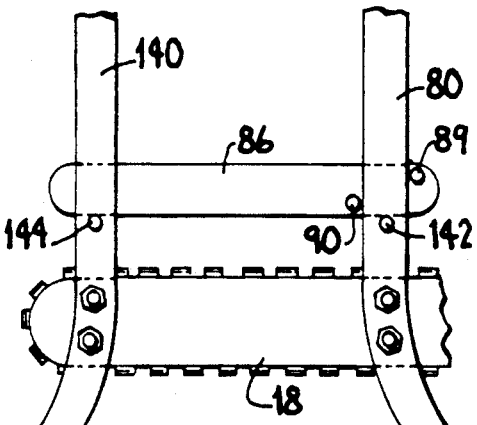
FIG. 7 is a diagrammatic illustration of a fourth embodiment of the anti-pinch device utilizing two vertical supports.

FIG. 7 illustrates a fourth embodiment of the present invention utilizing two vertical supports 80 and 140. Both vertical supports are constructed generally similar to vertical support 80 shown in FIG. 5. Translational or transverse movement of pinch arm 86 towards saw blade 18 is limited by lower stop pins 142 and 144, respectively, in vertical supports 80 and 140. Pinch arm 86 is also permitted to rotate with respect to vertical support 80 due to the positioning of fore and aft guide pins 90 and 89. This double vertical support embodiment is believed to provide additional safety for the tree cutter.

Figure 8:
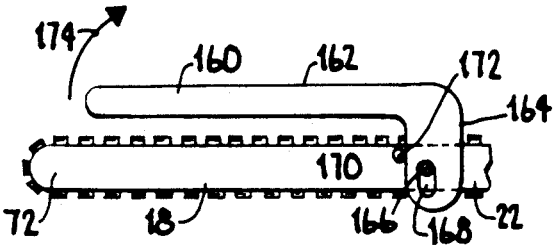
FIG. 8 is a diagrammatic illustration of a fifth embodiment of the anti-pinch device.

FIG. 8 shows a fifth embodiment of the present invention wherein pinch arm 160 includes a longitudinal portion 162, extending substantially along the length of saw blade 18 and a support portion 164 that is normal to longitudinal portion 162. Support portion 164 is movably mounted by a rotatable and translatory mount on aft region 22 of saw blade 18. In this embodiment, the mount is a pin 166, on aft region 22, that extends through a slot 168 in support portion 164 of the pinch arm. To limit the rotational movement of pinch arm 160 toward saw blade 18, a stop pin 170 is attached to saw blade 18. Stop pin 170 bears against a fore end control surface 172 of support portion 164.

Since the length of slot 168 is parallel the longitudinal extent of support portion 164, pinch arm 160 is capable of moving in a translational manner toward or away from saw blade 18. Since stationary pin 166 (which may be of quick release design) is only loosely placed in slot 168, pinch arm 160 is also capable of rotating in direction 174 away from fore end region 72 of saw blade 18.

Figure 9A:
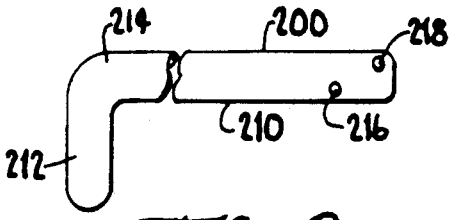
FIG. 9A is a diagrammatic illustration of a modification of the pinch arm having a nose guard extension.

FIG. 9A shows a modification of the pinch arm. Particularly, pinch arm 200 includes a longitudinal portion 210 and a nose portion 212 that extends beyond fore end region 214. Nose portion 212 is generally normal to longitudinal portion 210 and wraps around fore end region 72 of saw blade 18. Fore and aft guide pins 216 and 218 enable the pinch arm to be utilized in conjunction with the embodiments of the anti-pinch device in FIGS. 4A and 6A above. When the pinch arm includes a nose guard, kick-back of the saw toward the operator is minimized. Occasionally, the fore regions or nose of the saw blade will strike nails, stones, knots, etc. and cause the entire saw to kick-back to the tree cutter. The presence of nose guard portion 212 eliminates this as long as pinch arm 200 is relatively close to saw blade 18.

Figure 9B:
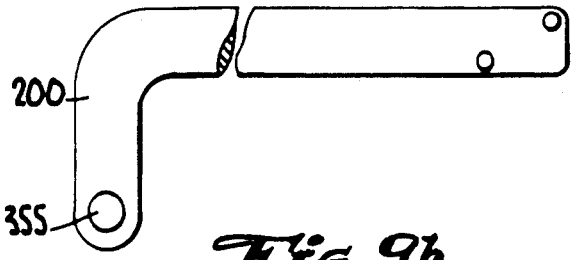
FIGS. 9B, 9C, 9D and 9E show modifications of the pinch arm.
Figure 9C:
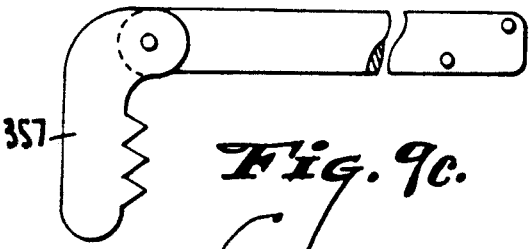
Figure 9D:
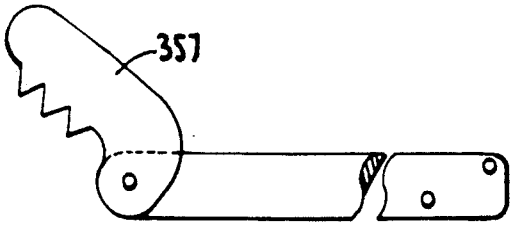

FIGS. 9B, 9C and 9D are similar to and modifications of FIG. 9A discussed. FIG. 9B includes an end stud 355 that could be an option on FIG. 9A and is meant to provide an efficient and user optional method of kickback protection by making hazardous forced withdrawal by the saw an impossibility. This curved arm with end stud 355 yields two modes of kickback protection. Mode one is achieved by simply shielding the cutter bar nose without the stud (FIG. 9A) which eliminates nose induced kickback. Mode two is accomplished by the use of the stud 355 which totally protects against kickback induced by means other than the nose (knots, hard spots, inclusions in the wood, etc.); this is in addition to the protection afforded by mode one. With either mode, the operator could still, however, rapidly remove the saw from the cut leaving only the anti-pinch arm behind.

FIG. 9B with or without the stud (which could be a quick release pin, bolt, etc.) in place is useful in those situations where the log diameter is less than or equal to the effective cutter bar length. Without the stud, (FIG. 9A), it can then be used in those situations where it is desired to pull the saw straight out of the cut as might be the case with wedges set; this might be necessary if a tree felling operation is not going as planned and the operator, for his safety, must rapidly vacate the area. This is not possible with the bolt on bar nose protectors offered by some manufacturers as they are significantly wider (thicker) than the bar consequently jamming when a withdrawal is attempted thus wasting valuable time if the operator's safety is in jeopardy.

With a log larger than the cutter bar, pinch bar 200, FIG. 9B, could be utilized with the stud in conjunction with the open top upright for automatic departure from the upright while staying in the cut affording pinch prevention with protection from the previously described log slide after cut completion. To make this departure feature applicable to log diameters smaller than the cutter bar length, it is possible to have various user selectable stud holes located up and around the arm nose even extending along the arm; for that matter, a multiplicity of quick release pin holes could be provided in a manner similar to that displayed in FIG. 4D.

The pinch bar illustrated in FIGS. 9C and 9D overcomes the cutter bar length limitation of FIG. 9B by using a rotatable nose 357 that folds up and out of the way (FIG. 9D) staying in the cut at all times to give continuous pinch protection while allowing large logs to be cut. Its width is such that it stays in the cut as it folds up to expose its interlocking "teeth" to the uncut portion of the log (that which is larger than the cutter bar) to prevent kickback. As an added benefit, saw control is also improved due to the leverage afforded by the interlocking "teeth." Nose 357 could be a unitary structure with a U-shaped portion overlaying the pinch arm end or could be configured as a double leg or straddle mounted spikes locked together as a unit.

For those logs that are smaller than the cutter bar, the rotatable nose 357 (FIG. 9C) can drop down below the lower surface of the cutter bar (by design, it can be made sufficiently long) so that the interlocking "teeth" can lock into the uncut portion of the log to prevent kickback and also improve the saw control through improved leverage. Though not shown, the nose could feature a restoring spring with a stop pin to fix the "at rest" position and also allow all position operation. The spring would yield additional force to set the interlocking teeth into the log which would ultimately increase the reaction force at the upright resulting in a more stable, controllable cutting process free of any kickback hazards.

Figure 9E:
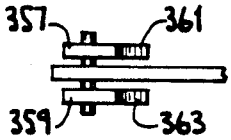

FIG. 9E is a straddle mount version of the pinch arm shown in FIGS. 9C and 9D that is intended for use in those instances where the log diameter is less than or equal to the cutter bar length. The spike elements 357 and 359 are mounted on the pinch arm and straddle the cutter bar. The elements are meant to continuously interlock with the log to prevent kickback by the two modes mentioned above. The advantage of multiple sets of toothed elements is that there is a higher probability of engagement with the log as the elements will engage independently of each other automatically accounting for log surface irregularities in the region of the cut. The toothed elements 361 and 363 could be spring loaded (with an at rest stop) to enhance their engagement capabilities. Further, the elements could also be of a quick release design for those emergencies where the operator wanted anti-pinch capabilities for log diameters greater than the cutter bar length. For log diameters significantly less than that of the cutter bar, the straddle mount element(s) pivot point could be adjustable along the length of the pinch arm; this is not shown on the drawing.

When used with an open top upright and a stud or a quick release pin, all of these designs can automatically depart from the upright (assuming a pinch condition or an appropriate log diameter relative to the outermost pin, stud, etc.) staying in the uppermost (or outermost) region of the cut providing optimum pinch protection commensurate with maximum "log slide" avoidance capabilities. It must be noted that all arm styles still offer total anti-pinch protection with quick removal capabilities.

Figure 10:
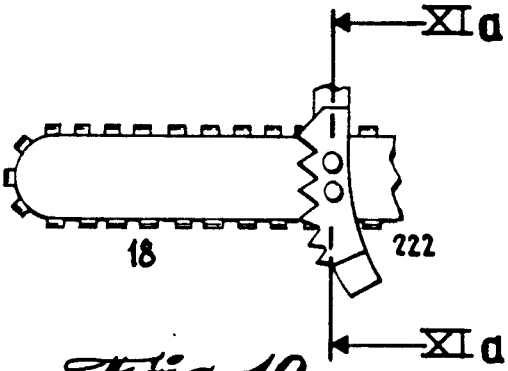
FIG. 10 is a diagrammatic view of the anti-pinch device having spiked bumpers.
Figure 11A:
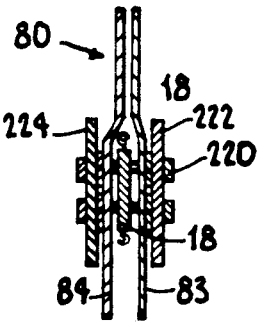
FIG. 11 is a partial, cross-sectional view of the anti-pinch device shown in FIG. 10 from the perspective of section line 11'—11"

FIGS. 10 and 11A diagrammatically illustrate a further modification of the anti-pinch device. Vertical support 80, consisting of support arms 83 and 84, extends about saw blade 18. Vibration isolation mounts, one of which is mount 220, attach spiked bumpers 222 and 224 to respective support arms 83 and 84. The vibration isolation mounts provide additional isolation of the vibration from the tree cutter. Vibration isolation mounts (elastomeric material, springs, damper, etc.), one of which is mount 220 (FIG. 11A), are used to attach, for example, spike bumpers 222 and 224 (which are used for leverage and control) to respective support arms 83 and 84. It should also be noted that the support arms 83 and 84 could be directly isolation mounted for similar benefits.

The vibration isolation mounts protect the operator from the chain induced vibration resulting from the interrupted nature of the chain. On a normal saw, the cutting forces (and the cutter induced vibrations) are reacted against by the engine crankcase and there is no direct method of isolating these from those caused by the engine. The improved method makes it possible to separate these forces by isolating and damping the cutter induced vibrations directly on the bar. Note should also be taken of the fact that arms 83 and 84 are not absolutely necessary to achieve cutter isolation—e.g., isolation mounted spike bumpers could be used by themselves as could isolation mounted reaction strips. The preferred method, however, is to use two reaction members to neutralize any side forces resulting from unbalanced torques due to the offset nature of a single reaction member relative to the cutter chain.

The upright legs 83, 84 in FIG. 11A could be encased in an elastomer (for example, rubber). The elastomer could surround the saw blade beyond the uprights such that the blade passes normally through the hole formed within the doughnut-shaped elastomer. This could be used with or without the spike bumper members 222, 224 in FIG. 11A. The encasement would not only offer vibration isolation, but would also interlock with the rough bark of the log to offer the operator better control and leverage.

It should be noted that the isolation system can be composed of multiple elements that have separate functions. For example, there could be a spring and damper system where the spring would supply the reaction force while the damper would be tuned to nullify a given range of vibrational frequencies. This system would be somewhat analogous to that of an automobile suspension where there is at each wheel a spring to support the weight and a tuned damper (shock absorber) to give a smooth ride.

Figure 11B:
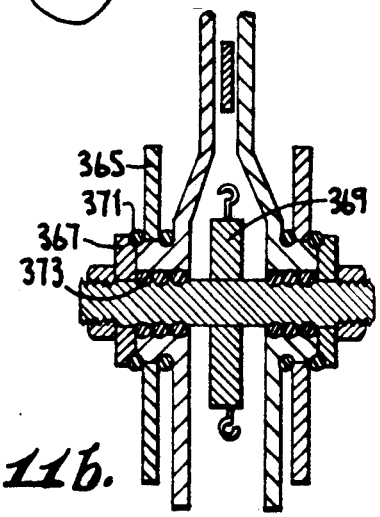

An example of a tuned isolation system for this application is shown in FIG. 11B; though somewhat similar to that shown in FIG. 11A, the design differs in some important characteristics. FIG. 11B is a view from the perspective of the chain saw engine looking outboard down the length of saw blade 369. This system uses a series of 0-rings nested about two cylindrical sleeves (inner one fixed, the outer "floating") to provide an isolation system that has frictional damping built into it through the interaction of the O-rings 371 and 373 with each other and also the inherent damping characteristics of the chosen material; this system would be bolted to the upright members. The spike bumper 365 is fitted to the "floating" cylindrical sleeve 367 which allows the several degrees of freedom necessary to account for the uneven surface features of saw logs. The O-ring size and material could readily be changed to account for different cutting conditions relative to the wood (hard or soft), the operator, or the actual chain saw. This system could also be used without the spike bumpers—for example, it could be used directly with the upright members.

The tuned isolation system shown in FIG. 11B could also be useful on the handle 112 (FIG. 4A) to reduce vibrational input to the operator. This could easily be customized for the operator, the saw, or the type of wood being cut.

FIGS. 12 through 19 show various modifications of the pinch arm.

Figure 12:
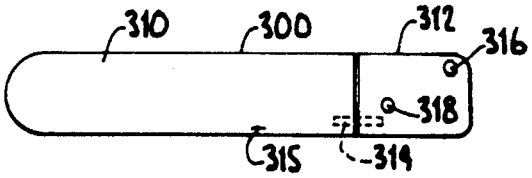
FIG. 12 is a diagrammatic view of a first modification of the pinch arm.

FIG. 12 diagrammatically illustrates pinch arm 300 having a longitudinal portion 310 that extends substantially parallel to the saw blade (not shown) and a guide portion 312 that is rotatably attached to longitudinal portion 310. Rotational movement of longitudinal portion 310 with respect to guide portion 312 is accomplished by a longitudinal pin 314. Guide portion 312 includes aft guide pin 316 and fore guide pin 318 that are disposed along along aft and fore edges of vertical support 80. Longitudinal pin 314 could be fixedly mounted in guide portion 312 and rotatably mounted in longitudinal portion 310 or vice versa. The effect of having longitudinal portion 310 rotatably mounted to guide portion 312 is that in the event of the kick back of the saw blade or involuntarily back motion of the blade in the saw cut, the longitudinal portion would rotate with respect to the guide portion thereby trapping the pinch arm in the saw cut. This provides additional kick-back protection in that the saw could not be involuntarily withdrawn from the saw cut due to the "pinched" condition of the pinch arm in the saw cut. Longitudinal pin 314 is disposed in a blade adjacent region 315 such that the longitudinal portion 310 rotates eccentrically with respect to guide portion 312 and the longitudinal center line of the unit.

Figure 15:
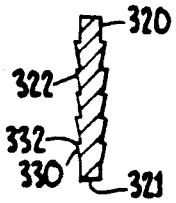
FIG. 15 is a cross-sectional view of the pinch arm shown in FIG. 13 from the perspective of section of 15'—15"
Figure 13:
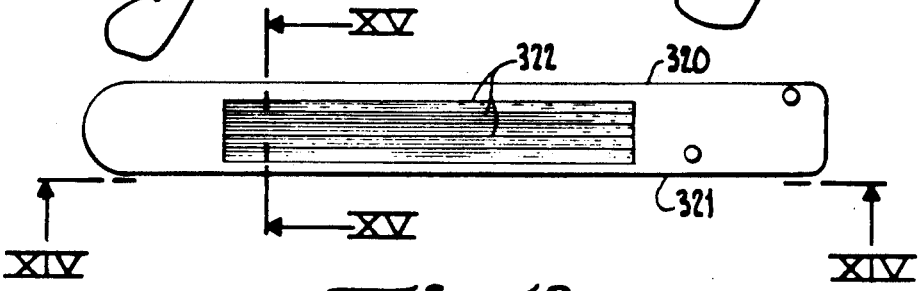
FIG. 13 is a diagrammatic top view of a second modification of the pinch arm.
Figure 14:
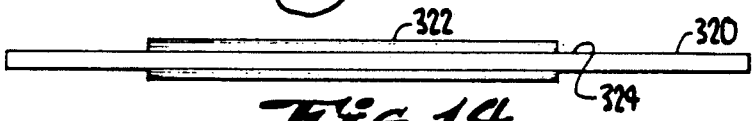
FIG. 14 is a side view of the pinch arm shown in FIG. 13 from the perspective of section line 14'—14"

FIGS. 13, 14 and 15 show another modification of pinch arm 320. Pinch arm 320 includes a plurality of serrations 322 that rise above planar surface 324 of the pinch arm.

Serrations 322 extend longitudinally over a portion of pinch arm 320. As shown in FIG. 15, pinch arm 320 has a blade adjacent surface 321 and the narrow base of each serration, such as base 330, is closest to blade adjacent edge 321 whereas the wider section of the serration 332 is disposed relatively remote with respect to the blade when compared with serration base 330. In operation, blade adjacent edge 321 of pinch arm 320 is inserted into the saw cut first as is serration base 330. If serration top 332 is disposed in the saw cut and the chain saw kicks back, serration top 332 would catch in the saw cut thereby providing additional kick-back protection for the tree cutter.

Figure 16:
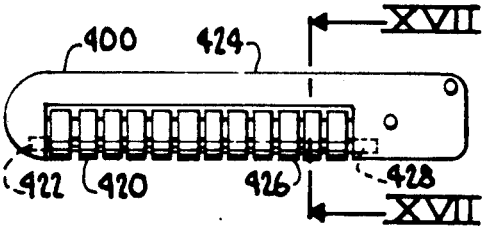
FIG. 16 is a third modification of the pinch arm.
Figure 17:
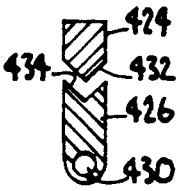
FIG. 17 is cross-sectional view of the pinch arm shown in FIG. 16 from the perspective of section line 17'—17"

FIGS. 16–19 show further modifications of the pinch arm which incorporate a plurality of rotatable segments. FIG. 16 shows pinch arm 400 with a plurality of rotatable segments 420 disposed along a blade adjacent edge 422 of the pinch arm. Pinch arm 400 includes a relatively stationary body 424 and the rotatable segments, one of which is segment 426 which is rotatable with respect to body 424. The rotatable segments rotate about a fixed shaft 428 mounted onto pinch arm body 424. Alternatively, the rotatable segments could be replaced by V-shaped spring members. The apex of the V-shaped springs are spring coils wrapped around shaft 428. The legs of the V fold into the log cut upon insertion of the pinch arm therein. FIG. 17 shows a partial, cross-sectional view of rotatable segment 426 and pinch arm body 424. Shaft 428 passes through longitudinally extending bore 430. Each segment has a limited rotational capacity due to an interfering stop projecting surface 432 extending toward segment 426 from pinch arm body 424. Rotating segment 426 includes a complementary control surface 434 that interacts with interfering stop surface 432 such that the rotating segment has only limited rotational movement or angular displacement with respect to the relatively stationary pinch arm body 424.

Figure 18:
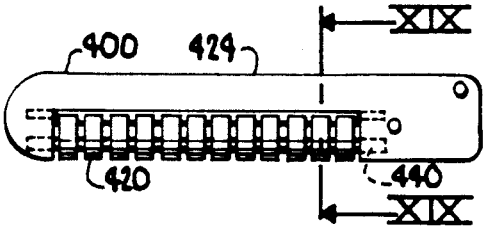
FIG. 18 is a fourth modification of the pinch arm.
Figure 19:
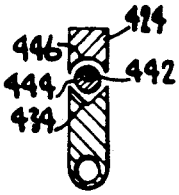
FIG. 19 is a cross-sectional view of the pinch arm shown in FIG. 18 from the perspective of section line 19'—19"

FIGS. 18 and 19 show a further modification of the pinch arm 400. FIG. 19 not only has rotatable segments 420 that rotate about pivot axis 440, but also includes an eccentric axis 442 that has shaft 444 disposed therein. FIG. 19 shows that although blade remote control surface 434 of the rotational segment is the same as shown in FIG. 17, eccentrically pivotal shaft 444 is disposed intermediate control surface 434 and a second control surface 446 on the blade adjacent segment side of pinch arm body 424. The eccentricity of rotatable shaft 444 forces the rotatable segments to move normal to the generally planar structure of the pinch arm when the arm is moved is backwards through the saw cut, for instance, when the operator wants to easily and quickly remove the saw.

Figure 20:
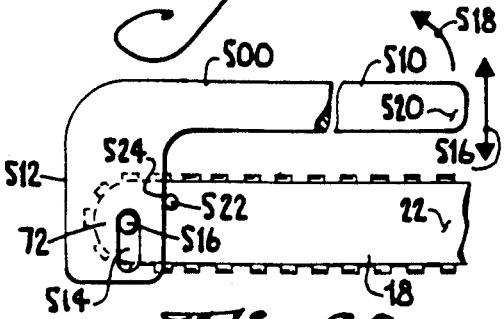
FIG. 20 is a sixth embodiment of the anti-pinch device that is rotatably and translatatively attached to a fore end region of the chain saw blade.

FIG. 20 illustrates another embodiment of the pinch arm that is rotatably and transversely mounted with respect to saw blade 18. This design gives saw bar nose protection at all times to eliminate nose-induced kickback. Pinch arm 500 includes a longitudinal portion 510 extending generally along saw blade 18. Pinch arm 500 further includes a support portion 512 normal to the longitudinal portion 510. Support portion 512 includes a longitudinally extending slot 514 through which passes stationary pin 516. Slot 514 enables pinch arm 500 to move in a translational direction, that is in direction shown by double headed arrow 516 with respect to saw blade 18 as well as to rotate in a direction shown by single headed arrow 518 away from aft end 22 of saw blade 18. To limit rotational movement of aft region 520 of pinch arm 500, a stop pin 522 is attached to saw blade 18. An aft control surface 524 limits rotational movement of aft end 520 toward saw blade 18.

Figure 21:
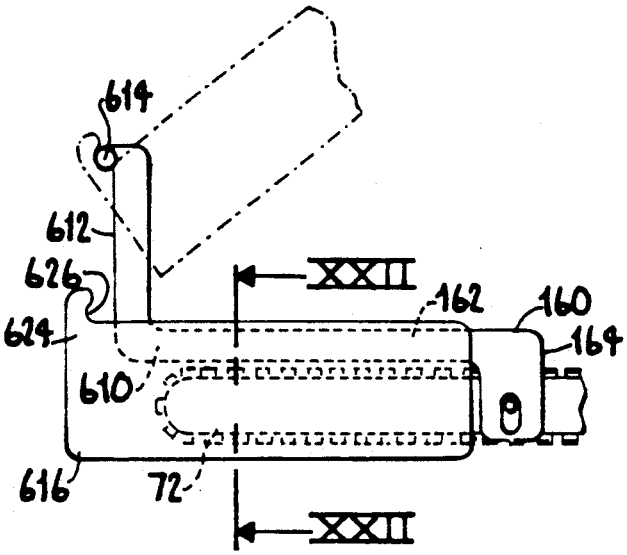
FIG. 21 is a modification of the anti-pinch device shown initially in FIG. 8 but further including a chain saw guard.
Figure 22:
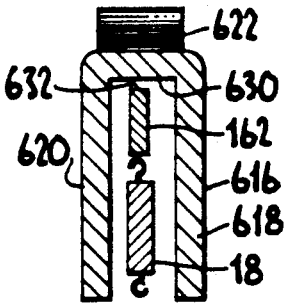
FIG. 22 is a cross-sectional view of the modified embodiment of the anti-pinch device and chain saw guard shown in FIG. 21 from the perspective of section line 22'—22" in FIG. 21.

FIG. 21 shows another modification of the anti-pinch device and includes generally a modified version of the pinch arm shown in FIG. 8. Pinch arm 160 includes, attached to its fore end region 610, a vertical extension 612 extending normal to longitudinal portion 162 of pinch arm 160. Attached to the blade remote end is a pivot pin 614. The pinch arm is combined with a blade guard 616 that acts as a sheath having two depending arms 618 and 620 depending from blade remote side 622. See FIG. 22. The surface 622 has a slot of sufficient length to allow guard rotation at pin 614 with clearance of uppermost end of 612. At fore end region 624 of blade guard 616 a curved control surface 626 is located that cooperates with pivot pin 614 when guard 616 is translated completely beyond longitudinal section 162 of pinch arm 160. The blade remote side 622 of blade guard 616 includes an interior topside control surface 630 that cooperates with at least a portion of longitudinal portion 162 of pinch arm 160. When blade guard 616 is at rest, control surface 630 rests atop internal blade remote edge 632 of longitudinal section 162.

Figure 23:
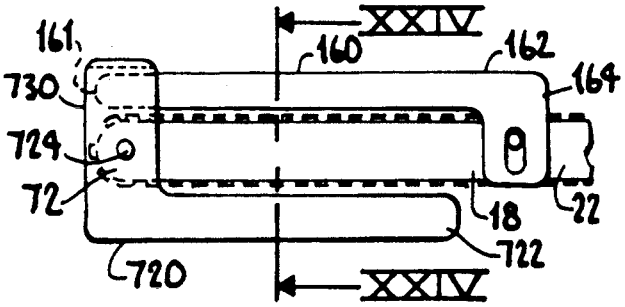
FIG. 23 is a second modification of the anti-pinch device shown in FIG. 8 having a bottom edge chain saw guard.
Figure 24:
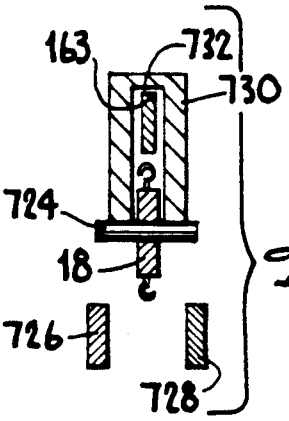
FIG. 24 is a cross-sectional view of the modified embodiment of the safety device shown in FIG. 23 from the perspective of section line 24'—24"

FIGS. 23 and 24 show the pinch arm embodiment of FIG. 8 with a blade guard modification. Pinch arm 160 includes at its fore end region 161 a control surface 163. A blade guard 720 includes a longitudinal portion 722 that extends substantially along a lower saw blade surface of blade 18. Blade guard 720 is pivotally attached via stationary pin 724 to fore end region 72 of saw blade 18. Longitudinal portion 722 of blade guard 720 consists of two, parallelly spaced guard arms 726 and 728. Blade guard 720 includes a fore end extension 730 that is generally normal to longitudinal portion 722 of guard 720. Fore end extension 730 includes an interior, topside control surface 732 that cooperates with fore end stop surface 163 of pinch arm 160 such that rotational movement of guard arms 726 and 728 away from aft region 22 of saw blade 18 is limited. Note that full bar nose protection is maintained at all times negating the chance of kickback. Further, a pre-load/restoring spring might be used to bring the guard back to rest position after the cut.

Figure 25:
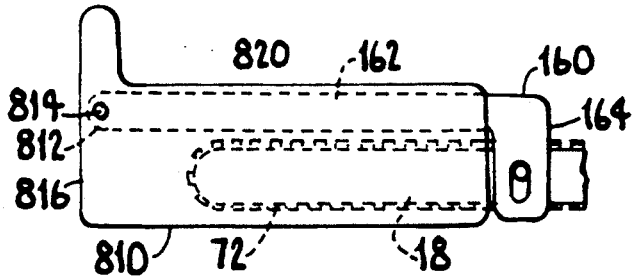
FIG. 25 is a third modification of the anti-pinch device shown in FIG. 8 and further including a chain saw blade guard that is pivotally mounted to a fore end region of the anti-pinch device.

FIG. 25 shows a further modification of a blade guard 810 and pinch arm 160. The longitudinal portion 162 of pinch arm 160 includes, at a fore end region 812, a pin connection 814. Pin connection 814 rotatably connects fore end region 812 of pinch arm 160 to fore end region 816 of blade guard 810. Blade guard 810 covers substantially all of saw blade 18 and is rotatably hinged to pinch arm 160 via pin 814. At blade remote side 820, blade guard 810 would include an internal top control surface that would cooperate with a blade remote stop surface of longitudinal portion 162 of pinch arm 160. The cooperation of the stop surface and the control surface would limit clockwise rotation of blade guard 810 about pivot point 814 in FIG. 25. In operation, blade guard 810 rotates counterclockwise when saw blade 18 enters and forms the saw cut in the tree. A spring may be used to restore the guard to rest position upon cut completion. Pinch arm 160 is adapted for translational movement with respect to saw blade 18 as well as rotational movement with respect to the saw blade as discussed above with respect to FIG. 8.

In all the embodiments, the width or thickness of the pinch arm is slightly less than the thickness of the saw cut or kerf. Additionally, the pinch arm could be shaped as a triangle with the apex of the triangle being the leading edge of the arm that enters the saw cut. Rather than the serrations shown in FIG. 13, other types of surface configurations could be incorporated into the pinch arm. The chain brake discussed with respect to FIGS. 4A and 5 could be incorporated into the anti-pinch arms discussed with respect to FIGS. 21–25. The pinch arm itself could be made of a wide variety of materials such as metals, plastics, or other materials and other geometries (rectangular, square, round, etc.). Also, it is possible to attach the vertical support to the housing/hand grip, etc.

The claims appended hereto are meant to cover modifications and changes with the spirit and scope of the present invention, as defined by a reasonable interpretation of the appended claims.

I claim:

1. An anti-pinch device for a chain saw comprising:

a vertical support mounted normal to a saw blade of said chain saw; and, a pinch arm comprising an elongated substantially planar bar which extends along said saw blade and normal to said support, said pinch arm being movable mounted on said support for both rotation and transverse movement with respect to said support, said pinch arm having a thickness slightly less than a saw kerf and disposed to follow said saw blade into said kerf.

2. An anti-pinch device as claimed in claim 1 including a transversely movable mounting means that is pivotally attached to said pinch arm, said transversely movable mounting means permitting substantially free translatory movement of said mounting means and said pinch arm relative to said support.

3. An anti-pinch device as claimed in claim 2 wherein said mounting means includes a through passage, through which said support passes, said through passage being angularly disposed with respect to the pivotally attached pinch arm.

4. An anti-pinch device as claimed in claim 3 wherein said mounting means includes a lower stop limiting the pivotal movement of said pinch arm in the direction of said saw blade.

5. An anti-pinch device as claimed in claim 3 wherein said mounting means includes an adjustable lower stop means for limiting translational movement of said pinch arm towards said saw blade.

6. An anti-pinch device as claimed in claim 1 wherein said support includes a pair of parallelly spaced apart support arms extending normal to said saw blade and said pinch arm is disposed between said support arms.

7. An anti-pinch device as claimed in claim 6 including a stop extending between said support arms and limiting the transverse movement of said pinch arm towards said saw blade and including a chain stop.

8. An anti-pinch device as claimed in claim 7 including a pair of guide pins disposed on said pinch arm at transversely displaced, fore and aft positions about said support arms.

9. An anti-pinch device as claimed in claim 8 wherein the forwardly disposed guide pin is placed closer to said saw blade as compared with the aft guide pin thereby permitting rotational movement of said pinch arm away from a nose region of said saw blade.

10. An anti-pinch device as claimed in claim 9 wherein at least the aft guide pin includes a quick release mechanism such that when that pin is removed, the pinch arm is operatively free from the saw.

11. An anti-pinch device as claimed in claim 10 wherein the support arms are joined at the top, away from the saw blade.

12. An anti-pinch device as claimed in claim 10 including a handle grip at the top region of the support arms.

13. An anti-pinch device as claimed in claim 11 wherein the support arms are pivotally mounted to said saw blade, and the device includes means for biasing said support arms and the extending pinch arm away from a nose of said saw blade.

14. An anti-pinch device as claimed in claim 11 including a further vertical support mounted to a nose region of said saw blade, the first support being mounted to an aft region of said saw blade, and said further support including a pair of support arms and a lower stop for limiting the transverse movement of said pinch arm towards said saw blade, said pinch arm being substantially freely translatable within the support arms of said further support.

15. An anti-pinch device as claimed in claim 11 wherein said pinch arm includes a nose guard that extends partially about a nose region of said saw blade.

16. An anti-pinch device as claimed in claim 15 wherein said nose guard is rotatably mounted onto said pinch arm.

17. An anti-pinch device as claimed in claim 11 including spiked bumpers mounted to the exterior of said support arms at an aft region of said saw blade.

18. An anti-pinch device as claimed in claim 11 wherein said pinch arm includes a longitudinal portion that extends substantially parallel to said saw blade and a guide portion through which extends said guide pins, said longitudinal portion being rotatably attached to said guide portion.

19. An anti-pinch device as claimed in claim 18 including a longitudinal pin fixedly mounted to said guide portion and said longitudinal portion being rotatable about said longitudinal pin, said longitudinal pin being disposed in a blade adjacent region of said guide portion.

20. An anti-pinch device as claimed in claim 11 wherein said pinch arm has serrations on at least one planar surface that is parallel to said saw blade, said serrations extending longitudinally over a portion of said pinch arm.

21. An anti-pinch device as claimed in claim 11 wherein said pinch arm includes a plurality of rotatable segments disposed along a blade adjacent edge of said pinch arm, said segments being rotatable with respect to a pinch arm body that holds said guide pins and which extends the length of said pinch arm.

22. An anti-pinch device as claimed in claim 21 wherein each segment has limited rotational capacity due to and interfering stop projecting towards said segments and a complementary control surface on each segment.

23. An anti-pinch device as claimed in claim 17 wherein said spiked bumpers are mounted onto said support arms by a vibration isolation mounting mechanism.

24. An anti-pinch device as claimed in claim 12 wherein the handle grip is mounted to the top of said support arms by a vibration isolation mounting mechanism.

25. An anti-pinch device for a chain saw comprising:

a pinch arm having a substantially planar longitudinal portion extending along a saw blade and a support portion normal to said longitudinal portion, said longitudinal portion being movably mounted by a rotatable and translatory mount on said saw blade of said chain saw for both rotation and transverse movement with respect to said saw blade, said longitudinal portion having a thickness slightly less than a saw kerf and disposed to follow said saw blade into said kerf.

26. An anti-pinch device as claimed in claim 25 wherein said rotatable and translatory mount includes a stationary pin extending through said saw blade and includes a slot, normal to said longitudinal portion in which said stationary pin travels, said rotatable and translatory mount including a stop pin attached to said saw blade, and said support portion including a fore end control surface that bears against said stop pin such that rotational movement of said longitudinal portion towards said saw blade is limited by said stop pin and said fore end control surface.

27. An anti-pinch device as claimed in claim 26 including a blade guard that covers a substantial portion of said saw blade, and means for pivoting said blade guard away from said saw blade, said means for pivoting located at a fore end region of said longitudinal portion such that said blade guard is adapted to rotate away from an aft region of said saw blade.

28. An anti-pinch device as claimed in claim 27 wherein said blade guard is a sheath having a blade adjacent side open to said saw blade and an opposite side portion that is closed, the closed side portion having an interior control surface that bears against a section of said longitudinal portion thereby limiting translatory movement of said blade guard towards said saw blade.

29. An anti-pinch device as claimed in claim 28 wherein said pinch arm includes a fore end, vertical extension that is normal to said longitudinal portion, said means for pivoting including a curved control surface located at a fore end region of said longitudinal portion and a pivot pin located at a blade remote region on said vertical extension.

30. An anti-pinch device as claimed in claim 26 including a blade guard, said blade guard includes a pair of parallelly spaced guard arms longitudinally extending along a portion of said saw blade opposite said longitudinal portion of said pinch arm, said blade guard rotatably attached to a fore end region of said saw blade, said blade guard having a fore end extension that is normal to said guard arms, said fore end extension having an interior top side control surface that cooperates with a fore end stop surface of said longitudinal portion of said pinch arm such that rotational movement of said guard arms away from an aft region of said saw blade is limited.

31. An anti-pinch device as claimed in claim 25 wherein said rotatable and translatory mount includes a stationary pin extending through said saw blade at a fore end location, and includes a slot, normal to said longitudinal portion in which said stationary pin travels, said rotatable and translatory mount including a stop pin attached to said saw blade, and said support portion including an aft end control surface that bears against said stop pin such that rotational movement of said longitudinal portion towards said saw blade is limited by said stop pin and said aft end control surface.

32. An anti-pinch arm for use in a chain saw cutting system comprising:

an elongated, substantially planar bar having a plurality of pin passages normal to the planar surfaces thereof, and disposed at predetermined longitudinal points along said bar, said bar having a thickness slightly less than a kerf of a saw cut; and, at least two pins removably insertable into said passages such that the pins, when inserted hang said bar in said kerf.

33. The anti-pinch arm as claimed in claim 32 including a pair of longitudinally spaced spiked legs extending normal to the longitudinal extent of said bar, said spikes of said spiked legs facing each other.

34. The anti-pinch arm as claimed in claim 33 wherein one of said spiked legs is longitudinally adjustable along said bar.

* * * * *